United States Patent [19]

Lappage et al.

[11] 4,112,662

[45] Sep. 12, 1978

[54] WINDING MACHINES

[75] Inventors: James Lappage, Christchurch, New Zealand; Neil Doggett, Middleton; Stephen William Yates, Bolton, both of England

[73] Assignee: Platt Saco Lowell Limited, Rossendale, England

[21] Appl. No.: 790,877

[22] Filed: Apr. 26, 1977

Related U.S. Application Data

[63] Continuation-in-part of Ser. No. 615,189, Sep. 19, 1975, abandoned.

[51] Int. Cl.[2] ..... D01H 5/28

[52] U.S. Cl. ..... 57/34 AT; 57/51.6; 242/54.4

[58] Field of Search ..... 242/54.4, 25 A, 18 A; 57/34 AT, 77.4, 51.6

[56] References Cited

U.S. PATENT DOCUMENTS

| | | | |
|---|---|---|---|
| 2,600,037 | 6/1952 | West | 242/54.4 |
| 3,225,533 | 12/1965 | Henshaw | 57/34 |
| 3,377,792 | 4/1968 | Walls | 57/77.4 X |
| 3,701,491 | 10/1972 | Brown | 242/25 A |

*Primary Examiner*—Edward J. McCarthy
*Attorney, Agent, or Firm*—Watson, Cole, Grindle & Watson

[57] ABSTRACT

Apparatus is disclosed for winding an elongate fibrous material, such as a sliver or roving, comprising: package tube mounting means to support first and second package tubes in winding positions in transversely spaced parallel relationship; a material delivery arm for delivering material first to one of the package tubes to form a first package and then to the other of the package tubes to form a second package; drive means for rotating the package tubes for winding on material; the delivery arm being arranged during the building of a package to contact the package at a winding-on point which lies in a plane containing the axes of rotation of the two package tubes and to deliver material at the winding-on point direct to the package under a winding tension localized in the region of the winding-on point by the delivery arm; first traversing means for causing relative traversing movement between each package tube and the delivery arm in the direction of the axis of rotation of the tube for building a parallel-build package on the tube and second traversing means operative during the building of each package to cause in a direction perpendicular to the axis of rotation of the tubes a relative displacement between the delivery arm and the package tube to accommodate the increasing diameter of the package being built on the tube and to maintain the winding-on point in the plane containing the axes of rotation.

10 Claims, 13 Drawing Figures

Figure 1:
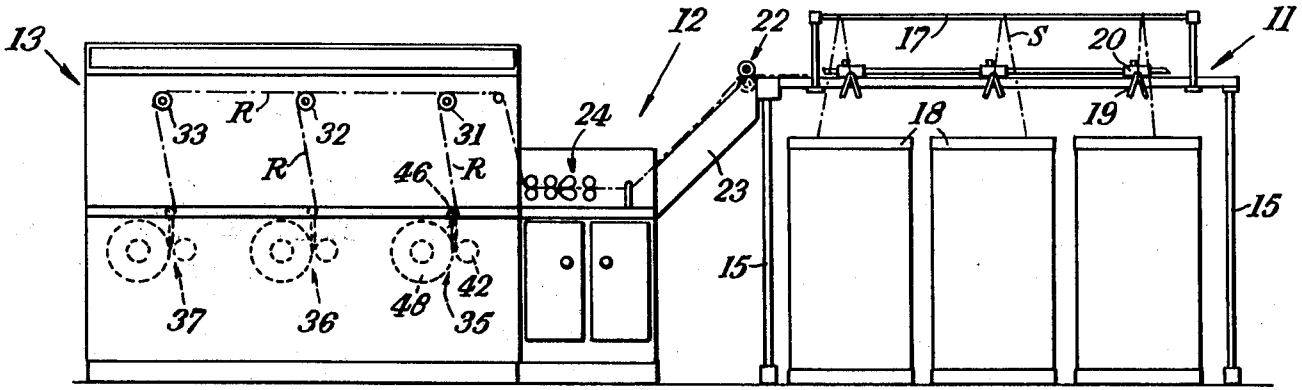

Fig. 12.
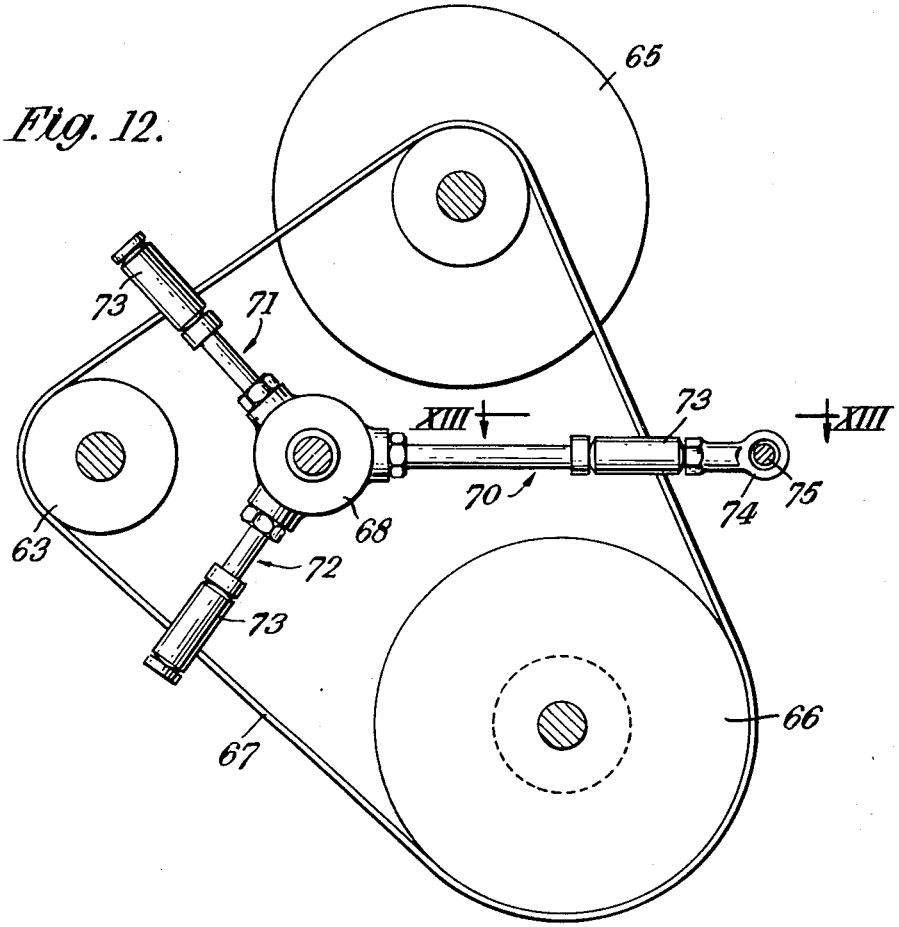
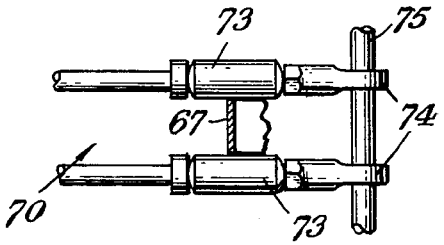
Fig. 13.

WINDING MACHINES

This application is a continuation-in-part of U.S. Ser. No. 615,189, filed Sept. 19, 1975, and now abandoned.

This invention relates to apparatus for winding elongate material into packages and particularly although not exclusively to apparatus for winding fibrous textile material in the form of sliver or roving.

When winding sliver or roving into packages, the packages build up very quickly because of the relatively large bulk of the material being wound. It is therefore desirable to provide a winding apparatus in which transfer of the winding material from a full package to an empty package tube can take place with a minimum of delay.

Mechanisms are known for winding filamentary material, such as wire, first on one and then on the other of two spools arranged in spaced parallel relationship whereby without any interruption of the feeding of the filamentary material from a supply the filamentary material is wound completely on one spool and then the winding is started on the adjoining empty spool in a fully automatic manner. All of these known mechanisms, which conventionally form parallel build packages, lead the material on to the spools in a manner such that the material is unsupported while under winding tension and are entirely unsuitable for winding material such as slivers and rovings at high speeds.

For roving or sliver it is necessary to lead the material to the winding position such that it is at no time under winding tension without being adequately supported to prevent breakage under the tension. In particular, in the winding of rovings or sliver an unsupported length greater than the mean fibre length should not be allowed while the length is under winding tension. To provide the necessary support for slivers and rovings it has therefore been customary to lead the material to the spool by means of a presser arm and machines known as balling machines are commonly employed. In a sliver-balling machine short cylindrical packages known as balls are formed by winding sliver on to a cylindrical core with the aid of a presser arm which bears against the package being formed and around which the sliver is wrapped in a succession of turns in its passage from a supply to the package so that there is no unsupported length of sliver longer than the fibre length which is placed under tension. The package is a contact driven package, that is to say, the package is rotated by peripheral contact with a drive roller and together with the presser is displaceable to accommodate the increasing diameter of the package. Such package driving arrangements are however suitable only for building low density packages at relatively low winding speeds. The package produced is furthermore a cross-wound package obtained by guiding the sliver so that adjacent turns are spaced widely apart in each course with the strands of one course diagonally overlapping those of the course immediately underlying it. The presser arm is asymmetrical and is adapted to lead material on to a package from one side only.

It is an object of the present invention to provide apparatus suitable for winding a sliver or roving into parallel build packages at high winding speeds in a continuous manner.

According to a first aspect of the present invention there is provided apparatus for winding an elongate fibrous material comprising: package tube mounting means to support first and second package tubes in winding positions in transversely spaced parallel relationship; a material delivery arm for delivering material first to one of the package tubes to form a first package and then to the other of the package tubes to form a second package; drive means for rotating the package tubes for winding on material; the delivery arm being arranged during the building of a package to contact the package at a winding-on point which lies in a plane containing the axes of rotation of the two package tubes and to deliver material at the winding-on point direct to the package under a winding tension localised in the region of the winding-on point by the delivery arm; first traversing means for causing relative traversing movement between each package tube and the delivery arm in the direction of the axis of rotation of the tube for building a parallel-build package on the tube and second traversing means operative during the building of each package to cause in a direction perpendicular to the axis of rotation of the tubes a relative displacement between the delivery arm and the package tube to accommodate the increasing diameter of the package being built on the tube and to maintain the winding-on point in the plane containing the axes of rotation.

Preferably, the delivery arm is pivotally suspended from arm support means and the relative displacement between the delivery arm and the two package tubes during the build of each package is such as to maintain the delivery arm in a substantially vertical disposition throughout the build of a package on each tube. The second traversing means is made responsive to completion of a package on one of the tubes to cause further relative displacement between the delivery arm and the package tubes to bring the delivery arm to bear against the other package tube to effect transfer to the other package tube of the material delivered by the delivery arm. The arm support means is then arranged during such further relative displacement to move beyond the position in which the delivery arm is vertical and contacts the other package tube, thereby to incline the arm and cause it to bear against the periphery of the tube. Preferably, the arrangement is such that the delivery arm at the completion of a package on one of the tubes almost contacts the surface of the other tube.

The delivery arm may be of generally cylindrical form and the material guided to the winding-on point in a plurality of turns around the cylindrical portion of the arm. The arm is furthermore preferably made symmetrical with respect to a plane passing through the longitudinal axis of the arm and includes an end portion adapted to deliver the material from one side thereof to wind material on to one of the package tubes and from the other side thereof for winding material on to the other package tube.

In a textile machine for converting sliver to roving the basic requirements are a drafting system to reduce sliver to roving weights and a collecting system to impart some twist to the sliver to produce a roving and to assemble the roving into a useful packaged form.

With short staple fibres, this has been conventionally done on a speed frame wherein a parallel wound package of high density is built up on a bobbin with the insertion of twist, which provides the roving with sufficient strength to allow it to be wound up at a relatively high tension. The insertion of real twist is, however, laboriously achieved by means of a flyer which rotates at a speed greater or less than the package spindle and the production speed of the machine is severely limited by its use.

The twist is inserted for a number of reasons, namely:

(1) to impart some strength to an otherwise weak strand thereby to facilitate winding into a package at the roving frame and unwinding from the package at the ring frame, and also to minimise surface damage in handling and storing roving packages;

(2) to help consolidate the loose fibre bundle into a more compact and controllable form;

(3) to control fibres during drafting.

With long staple fibres, a rubbing finisher has commonly been employed, the fibres after drafting being consolidated by rubbing in a transverse direction, whereupon the roving is wound into a crosswound package under low tension.

According to a second aspect of the present invention there is provided a textile machine for converting sliver to roving comprising sliver supply means arranged to provide two slivers for forwarding, means for drafting the forwarded slivers, twisting means for subjecting at least one of the drafted slivers to twisting, converging means for converging the two slivers to form a two-fold roving, and a winding device for winding the roving, the winding device comprising package tube mounting means to support first and second package tubes in winding positions in transversely spaced parallel relationship, a delivery arm for delivering the roving first to one of the package tubes to form a first package and then to the other of the package tubes to form a second package, drive means for rotating the package tubes to wind on the roving, the delivery arm being arranged during the building of each package to contact the package at a winding-on point which lies in a plane containing the axes of rotation of the two package tubes and to deliver the roving at the winding-on point direct to the package under a winding tension localised in the region of the winding-on point by the delivery arm, first traversing means for causing relative traversing movement between each package tube and the delivery arm in the direction of the axis of rotation of the tube for building a parallel-build package on the tube, and second traversing means operative during the building of each package to cause in a direction perpendicular to the axes of rotation of the tubes a relative displacement between the delivery arm and the package tube to accommodate the increasing diameter of the package being built on the tube and to maintain the winding-on point in the plane containing the axes of rotation.

It is known to form a stable twisted thread from two strands by twisting one or each of the strands such that it has repeated along its length alternating zones of opposite twist and stabilising the twisted strand or strands by converging them and allowing the twisted strand or each of the twisted strands partly to untwist around other strand. It is also known to apply this principle, which is commonly known as self-twist, to the manufacture of rovings.

Preferably, the twisting means in the machine according to the second aspect of the invenion applies to at least one of the drafted slivers a twist such that the twisted sliver has repeated along its length alternating zones of opposite false twist. The false twisted sliver in converging with the other sliver to form the two-fold roving is then allowed partly to untwist around the other sliver to form a stabilised self-twist two-fold roving.

The wind-up system of a conventional speed frame introduces unidirectional twist into the material being built into a package by it. This wind-up system is unacceptable for packaging a two-fold roving which needs to be separated into its two components for subsequent processing, as the unidirectional twist inserted prevents the components from separating. A machine according to the second aspect of the invention while producing a roving package which is similar to that produced on the conventional speed frame, that is to say, a high-density parallel-wound package, does not suffer from this disadvantage and the two-fold roving can readily be separated into its components at the ring frame for processing the separate components into yarn.

According to a third aspect of the present invention there is provided a textile machine for converting sliver to roving comprising a creel for withdrawing two slivers from respective supply cans for forwarding; drafting means for drafting the forwarded slivers to form rovings; twisting means comprising a pair of rollers, means mounting the rollers to form a nip therebetween and means for driving the rollers such that each rotates about its axis to forward the rovings through the nip and such that each reciprocates along its axis in opposite phase to the other to introduce alternating zones of opposite twist into the rovings; means for converging the rovings to form a two-fold roving; and a winding device for winding the rovings, the winding device comprising package tube mounting means to support first and second package tubes in winding positions in transversely spaced parallel relationship, a delivery arm for delivering the roving first to one of the package tubes to form a first package and then to the other of the package tubes to form a second package, drive means for driving directly the package tube mounting means for rotating the package tubes to wind on the roving, the delivery arm including means for contracting the package during building of each package and means to deliver the roving at the contact point to the package under a tension localised in the region of the contact point by the delivery means, and means for causing relative traversing movement between each package tube and the delivery arm in the direction of the axis of rotation of the tube for building a parallel-build package on the tube.

The twisted slivers may be converged in such a manner that each sliver partly untwists around the other sliver to form a self-twist two-fold roving or the slivers may be converged in such a manner that they form a two-fold roving in which they lie in side-by-side parallel relationship with consolidating residual twist in each of them.

Figure 2:
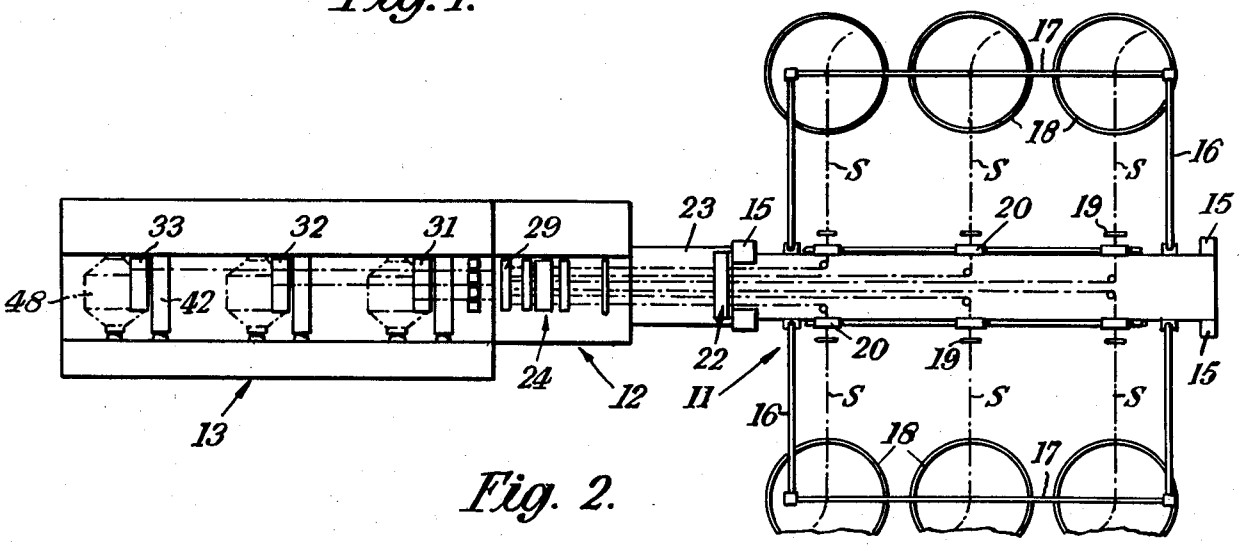
Figure 3:
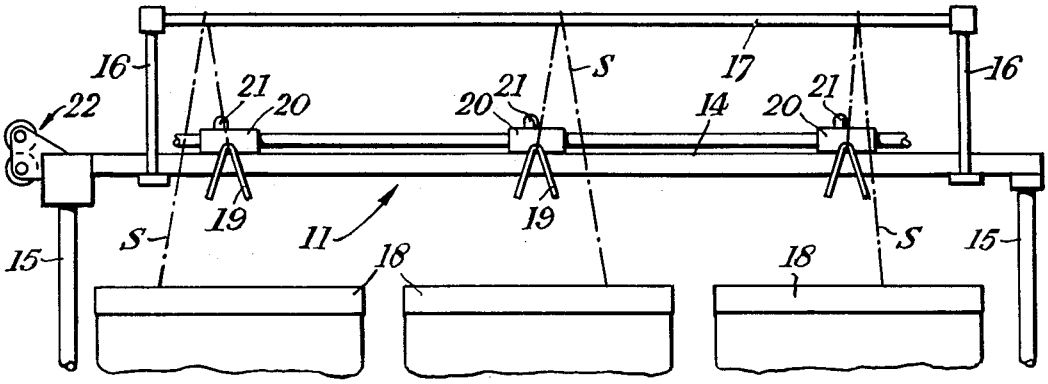
Figure 4:
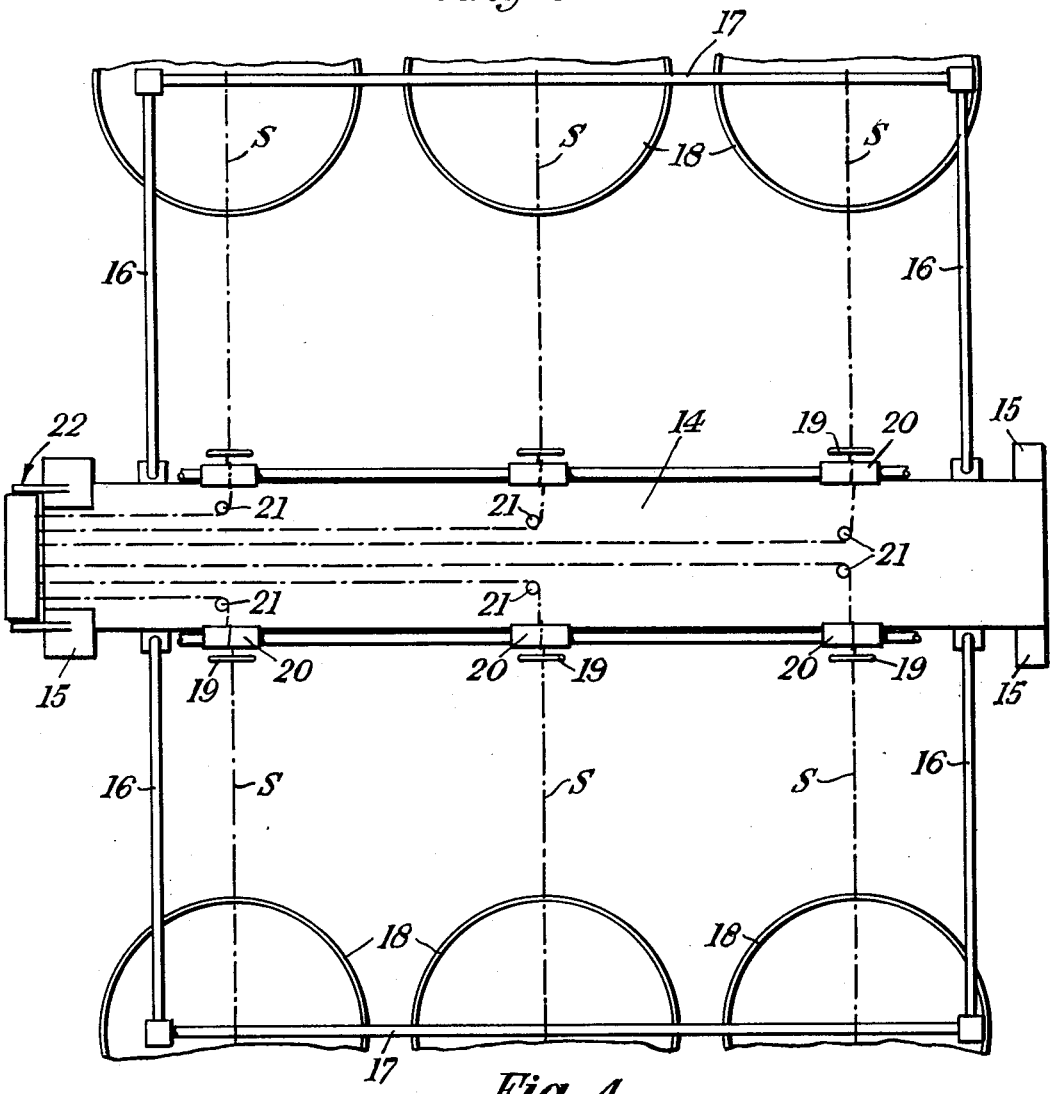
Figure 5:
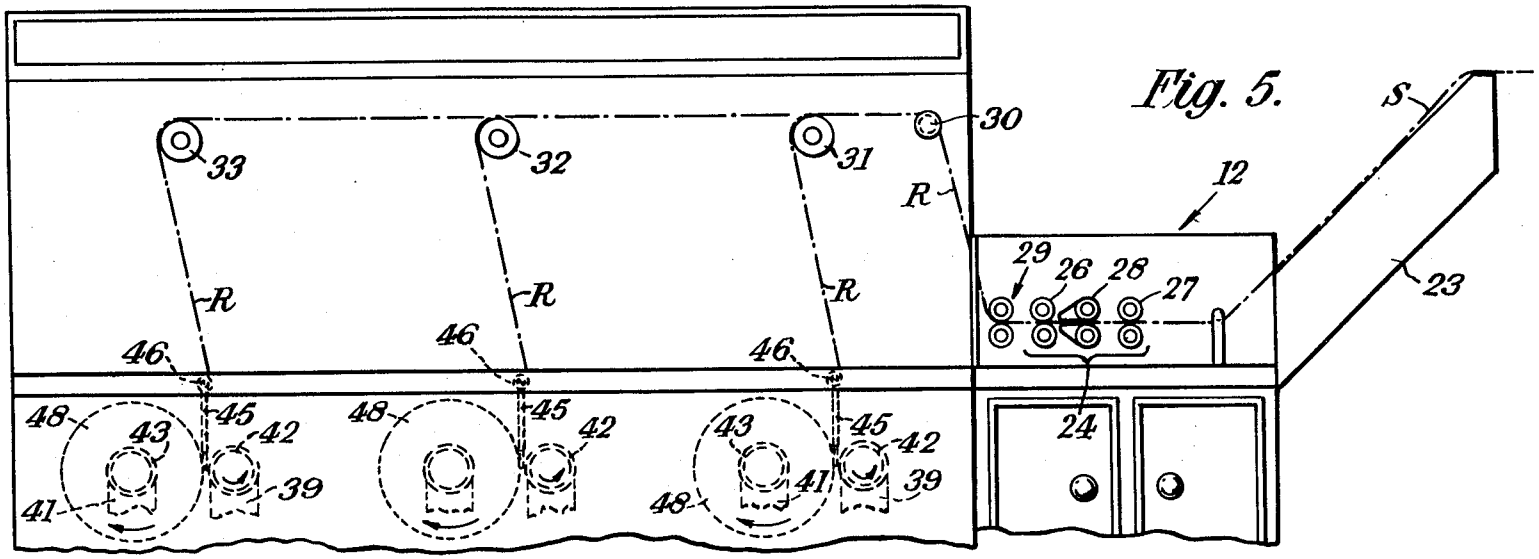
Figure 6:
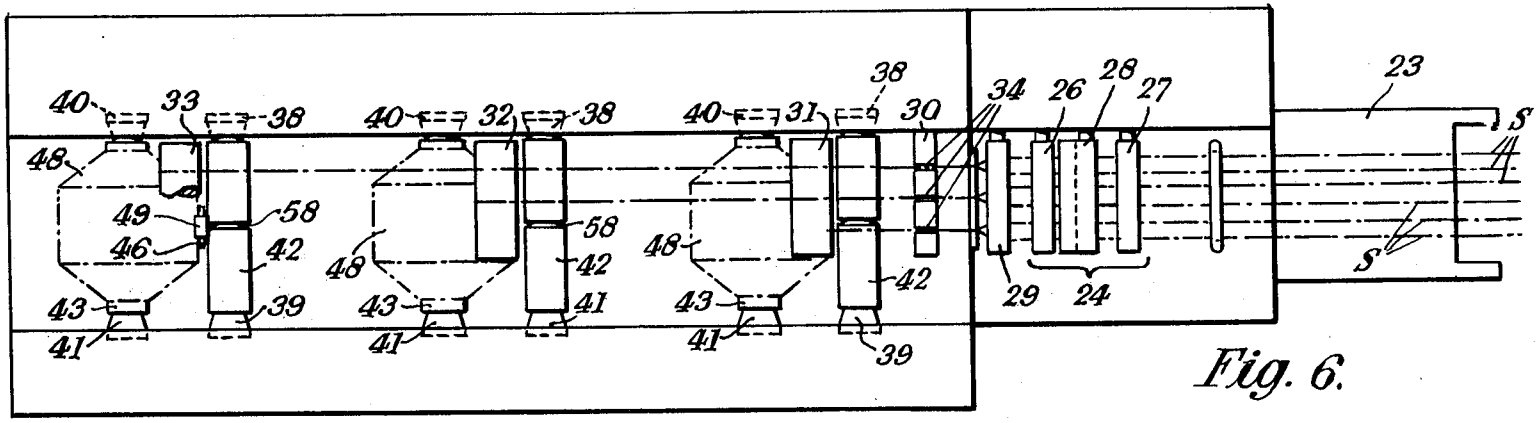
Figure 7:
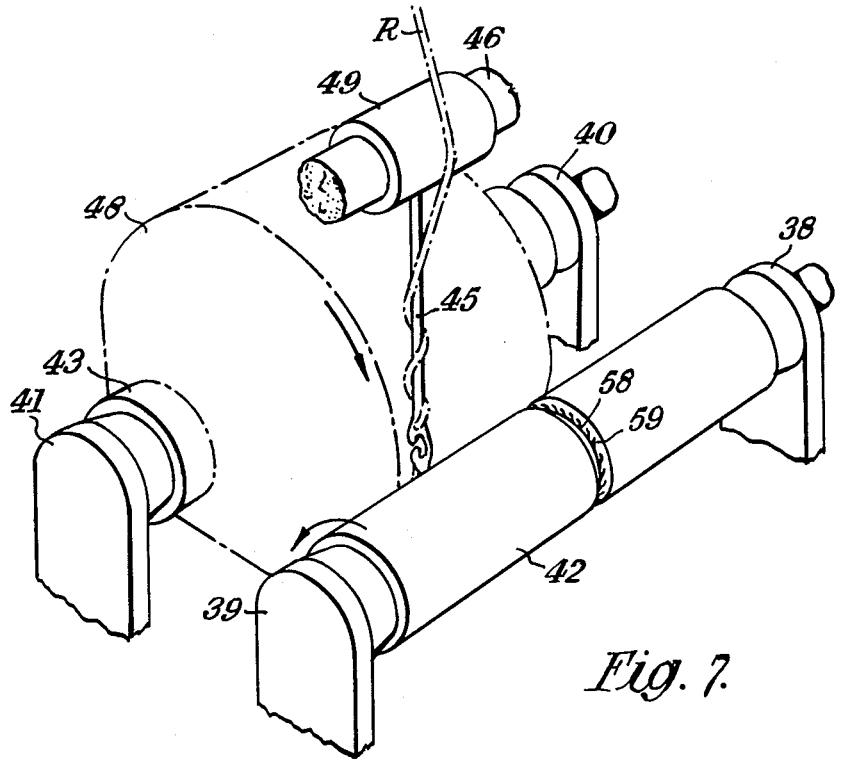
Figure 8:
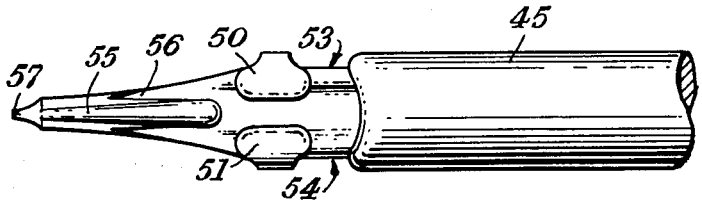
Figure 9:
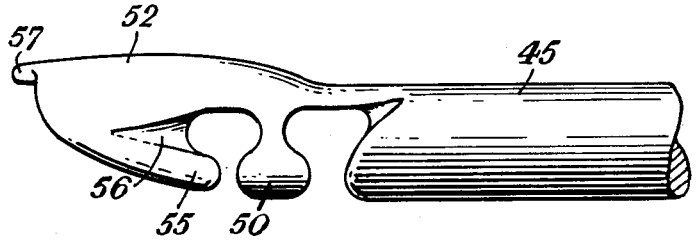
Figure 10:
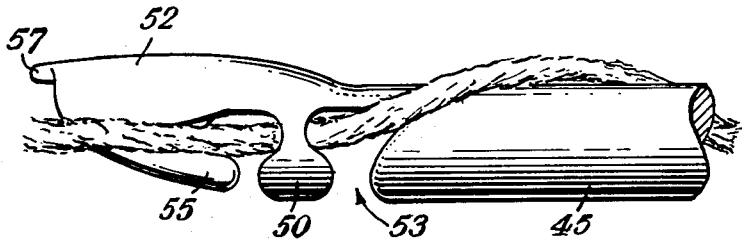
Figure 11:
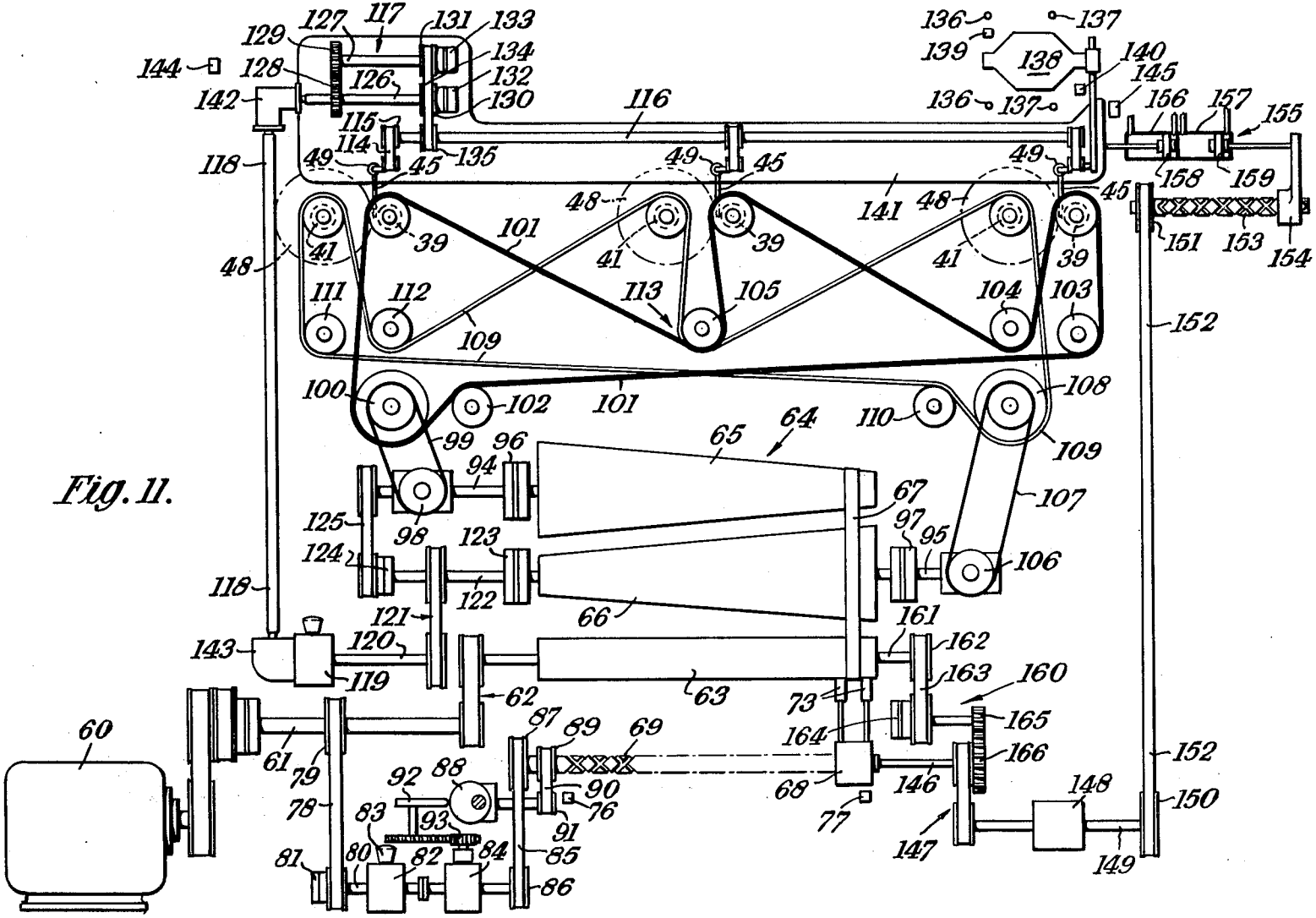

One embodiment of the invention will now be described by way of example with reference to the accompanying drawings in which:

FIG. 1 is a side elevation of a textile machine according to the present invention for converting sliver to roving, FIG. 2 is a plan of the machine shown in FIG. 1, FIG. 3 is a part side elevation drawn to an enlarged scale of the creel section of the machine shown in FIG. 1, FIG. 4 is a part plan of the creel section shown in FIG. 3, FIG. 5 is a part side elevation, drawn to an enlarged scale, of the drafting and twisting and the winding sections of the machine shown in FIG. 1, FIG. 6 is a plan of the sections of the machine illustrated in FIG. 5, FIG. 7 is a perspective view of winding apparatus employed in the winding section of the machine shown in FIG. 1, FIGS. 8 and 9 are side and front elevations of part of the material delivery arm illustrated in FIG. 7, FIG. 10 is a front elevation of the part of the delivery arm shown in FIG. 9, supporting a roving to be advanced for winding into a package, FIG. 11 is a schematic side elevation of drive mechanism for the textile machine illustrated in FIGS. 1 to 10, FIG. 12 is an end view of part of the drive mechanism illustrated in FIG. 11, drawn to an enlarged scale, and FIG. 13 is a plan view of part of the mechanism shown in FIG. 12, taken on the line XIII-XIII in FIG. 12.

Referring firstly to FIGS. 1 and 2, the machine shown comprises a creel section 11, a drafting and self-twisting section 12 and a winding section 13.

As best seen in FIGS. 3 and 4, the creel section 11 comprises a horizontal platform 14 mounted on legs 15 and carrying outstanding arms 16 which support a pair of rails 17 arranged parallel to the platform 14. Each of the rails 17 is carried at a position spaced outwardly and upwardly from the platform 14 so as to overhang a space for receiving three sliver cans 14 arranged at the side of the platform 14 and containing slivers S. At a position on the platform 14 adjacent each sliver can 18, there is arranged a guide 19, a drive roller 20 and a guide pin 21. The guide 19 is in the form of an inverted V and holds down the sliver S as it is drawn over the rail 17. The drive roller 20 provides a forwarding drive on the sliver S to ensure that it is at no position under sufficient tension to cause an end break. The guide pins 21 are so arranged on the platform 14 that the slivers S from the cans 18 travel along the platform in side-by-side spaced parallel relation.

End break detectors (not shown) are positioned to detect end breaks in the sliver S on each side of the roller 20 and to stop the machine should an end break occur at any time. The guide 19 also serves the purpose of a bunch detector in that if the sliver S passing through the guide is withdrawn from the can incorrectly in the form of a knot or bunch, the guide 19 is moved by the knot or bunch to stop the machine and indicate the condition to an operator.

A pair of forwarding rollers 22 is positioned at the end of the platform 14 to control and provide the forwarding drive for all six slivers S on the platform 14.

Referring now to FIGS. 5 and 6, a chute 23 directs the slivers S from the creel section 11 to the drafting and self-twisting section 12. The drafting and self-twisting section 12 is, as shown, formed as a separate module, distinct from both the creel and the winding sections 11 and 13. It may, however, be formed integrally with the wind-up section 13. The section 12 includes a conventional drafting system 24 including front and rear drafting rollers 26 and 27 and apron drafting roller assemblies 28 as is well known. In the drafting system the slivers S are drawn to roving weights in a similar manner to that effected on the conventional speed frame.

From the drafting system 24, the drafted slivers S are communicated directly to a pair of self-twist rollers 29 which, as is well-known, drive the slivers S forward while oscillating along their length in out of phase relationship. As explained in British Patent Specification No. 1,015,291 this produces an alternating twist along the length of each sliver S. As the slivers S emerge from the rollers 29 they combine in pairs, in each of which the slivers twist around each other to produce a two-fold roving R.

The three two-fold rovings R which emerge from the drafting and self-twist section 12 are substantially stronger than twistless slivers and hence can undergo substantially more tension before breaking. Furthermore, the self-twist inserted consolidates the rovings, reducing the amount of stray fibres.

The winding section 13 includes a fixed upper guide 30 and three driven rollers 31, 32 and 33 over which the rovings R pass. The guide 30 carries all three two-fold rovings and includes three grooves 34 to maintain separation of the rovings as they travel over the guide 30 in spaced parallel relation and to ensure that no undesirable contact takes place between them. The first roller 31 also carries all three two-fold rovings and is arranged such that two of the rovings may continue across the top of the machine to the rollers 32 and 33, while the third roving is directed donwardly to a winding station indicated at 35. The two remaining rovings pass respectively over the roller 32 and to a winding station 36 and over the rollers 32 and 33 and to a winding station 37.

Each of the rollers 31, 32 and 33 includes a guide (not shown) for guiding the roving which at that roller is directed downwardly to the associated one of winding stations 35, 36 and 37, the guide holding the roving on the roller against motion induced by the winding operation at the winding station.

The rollers 31, 32 and 33 may include co-operating cott rollers (not shown) to nip the rovings and thereby accurately control their forward motion. Alternatively there may be replaced by stationary guides.

The winding stations 35, 36 and 37 are indentical and description will therefore be made of winding station 35 only. The station 35 includes two pairs of bobbin mounting members 38, 39 and 40, 41. The two pairs of mounting members 38, 39 and 40, 41 are arranged to support package tubes 42 and 43, each pair comprising two stub shafts mounted in spaced coaxial relation and arranged by relative axial movement thereof to enter into supporting engagement with ends of the package tube, the stub shafts co-operating to hold the package tube coaxially therewith for conjoint rotation about a common axis. The package tube 42 can be dropped from the stub shafts by outward axial movement of the stub shafts to enable the replacement of a full package by an empty tube. The package tubes 42 and 43 thus carried by the mounting members 38, 39 and 40, 41 are, as shown, arranged in transversely spaced parallel relation.

The stub shafts of the mounting members 39 and 41 are driven in a manner hereinafter to be described, the stub shaft of the member 39, as viewed in the elevation of FIG. 5 being rotated in a counter clockwise direction and the stub shaft of the member 41 in a clockwise direction. The speeds of the drives are controlled as hereinafter to be described to ensure that the wind-up of roving on to each package remains at a constant speed taking into consideration the increasing diameter of the roving package.

In order to control the passage of the roving on to the package there is provided for each of the stations 35, 36 and 37, a depending delivery arm 45 pivotally supported by a support 46. The depending arm 45 is shown schematically in FIG. 5 and in better detail in FIGS. 7 to 10.

Referring now to FIGS. 7, roving R passing downwardly from the roller 31 is wrapped over the support arm 46 and then around the delivery arm 45 in a number of wraps, finally leaving the arm 45 and being passed immediately on to a package 48 into which the roving is being wound on the package tube 43. In this way, tension is set up in the roving R as it passes to the package 48 to cause the winding-on tension to be sufficiently high to produce a tight package of high density. Furthermore, the roving R is, at any position along its length, prevented by the arm 45 from being under winding tension without sufficient support to prevent an end break.

In a manner hereinafter to be described, the diameter of the package being wound is monitored and alters the position of the support arm 46 accordingly, that is, the arm 46, as shown in FIG. 6, is moved rightwardly as the package increases in diameter and maintains its vertical disposition.

Furthermore, in a manner hereinafter to be described, the support arm 46 and hence the delivery arm 45 is subjected to a traverse motion relative to the tube 43 such that the roving is laid in parallel closely positioned wraps around the package tube 43. As will hereinafter be explained, the length of the traverse is gradually decreased as the diameter of the package 48 increases so as to build a double taper package as conventionally built on a speed frame and the traverse rate is decreased as the diameter of the package 48 increases to account for more roving being required to be laid at any one axial position for a complete revolution of the package.

When the diameter of the package 48 being wound reaches a predetermined maximum diameter the arm 45 is in a manner hereinafter to be described moved toward the empty package tube 42 so as to carry the roving R on to the empty tube 42 for winding thereon.

Referring again to FIG. 7, the delivery arm 45 comprises an elongate cylindrical portion fixed to a boss 49 rotatably mounted on the support arm 46. The arm 45 is formed with a smooth surface to prevent any snagging of the roving being wound. The arm 45 at the end remote from the bar 46 is so shaped as to control the laying of the roving on to the package, the roving being wrapped, as shown, in a number of wraps around the arm and the laid directly under the control of the arm on to the package.

Referring now to FIGS. 8, 9 and 10, the free end of the arm 45 comprises a pair of curved fins 50 and 51 which generally follow the cylindrical surface of the arm and are connected to the arm by a back rib 52 which extends beyond the fins 50 and 51 substantially to a point. The back rib 52 is bent slightly out of the arm as best shown in FIG. 9. The fins 50 and 51 define openings 53 and 54 through which the roving may pass. The openings are chamfered to ensure the roving passes over no sharp edges. The ends of the fins 50 and 51 remote from the rib 52 are spaced apart to allow threading of the roving R as shown in FIG. 10 to a position in which it passes through one of the openings 53 and 54 and then passes between the fins 50 and 51 along the axis of the arm 45. The curve of the fins prevents the roving from escaping.

A further single fin in the form of a blade 55 stands up from the back rib 52 and lies in a plane passing through the axis of the arm. The roving R emerging from between the fins 50 and 51 runs along one side of the blade 55 and on to the package, with that side of the blade pressing against the package to smooth the roving on to the package. The blade 55 as shown at 56 is chamfered to avoid presenting sharp edges to the roving. At the end of the blade 55 adjacent the point of the back rib 52 there is provided a notch 57 for engaging the roving and preventing it slipping over the back rib 52 when the arm 45 is being traversed in a direction tending to cause such motion of the roving.

The blade 55 is so positioned relative to the bar 46 that it lies in a plane including the axes of the associated two spaced parallel package tubes 42 and 43. As the arm 45 is arranged to remain vertical or substantially vertical, the blade 55 always lies in a plane tangential to the package being formed.

The construction of the arm 45, and the manner in which the roving is supported by it and applied to the package ensures that the arm 45 applies a winding-on tension to the roving sufficient to form a firm high density package. At the same time it localises the winding-on tension at the winding-on point, so that at no time does the roving while under winding-on tension remain unsupported over a distance longer than the mean fibre length.

When the left-hand package 48 being wound at each station is sufficiently large, the support arm 46 carrying the arm 45 is moved to a position in which the bar 46 is to the right of the vertical plane passing through the rotary axis of the empty right-hand package tube 42, thereby bringing the blade 55 of the arm 45 to bear against the left-hand side of the empty right-hand tube 42 with the arm 45 lying at an angle of the order of 30° to the vertical. As winding traverse of the arm 45 continues, the roving is drawn across the surface of the empty package tube 42 while being wound upon the full package. The spacing of the package tubes 42 and 43 is so arranged that the package being built, when filled, almost contacts the surface of the empty package tube, whereby the winding of the roving on to the package continues without danger of breaking the roving.

The empty package tube 42 as shown in FIG. 7 has at a position along its length a circumferential groove 58 of rectangular cross-section with teeth 59 turned inwardly and in one direction around the circumference. In use, the empty package tube 42 is arranged such that the teeth 59 project in the direction of rotation, in this case counterclockwise. Thus, when the roving encounters the groove 58, it enters it and is caught by the teeth 59 to commence winding on the empty package tube. As the full package 48 and the empty package tube 42 are rotating in opposite directions the roving R is pulled sufficiently to break it without removing it from the groove 58. In this way, winding continues on the empty package tube 42 and the full package 48 is free to be doffed and replaced by a fresh empty package tube.

Immediately winding of roving on to the empty package tube 42 commences, tension in the roving tends to pull the roving from the side of the blade 55 which it occupies in FIG. 3 to the opposite side, that is to say, the side adjacent the package tube 42 on which a new package is being wound. The roving thus slips to the other side provided the direction of traverse is such as to tend to pull it away from the rib 52. If the direction of traverse is opposite to this, the roving will not move to the other side of the blade 55 until the direction of traverse alters.

Thus it will be apparent that the arm 45 is symmetrical with respect to a plane perpendicular to the plane including the axes of the packages so as to be able to direct roving on to the left-hand or right-hand package.

A drive system for driving the package tube mounting members 38, 39 and 40, 41 at appropriate variable speeds, for traversing the delivery arms 45 in the direction of the package tube axes to produce parallel-build packages and for displacing the arms 45 in a direction at right angles to the package tube axes to take account of the increases in diameter of the packages being built, as well as for further displacing the arms 45 to bring them into roving-transfer engagement with the empty bobbin tubes will now be described with reference to FIGS. 11 to 13.

In the drive system shown in FIGS. 11 to 13, a main drive motor 60 drives a main drive shaft 61 which in turn drives via a pulley and belt system 62 the input drive roller 63 of a cone drive system 64. The system 64 comprises the roller 63 which is cylindrical and a pair of identical cone pulleys 65 and 66 formed by straight sided frusto-cones with their apexes facing in opposite directions. While for convenience of illustration in FIG. 11 the cone pulleys 65 and 66 and the roller 63 are shown one above another, they are in fact arranged, as shown in FIG. 12, with their axes located at the apexes of a triangle, a drive belt 67 being wrapped around them under sufficient tension to communicate drive from the roller 63 to the pulleys 65, 66. As the pulleys 65, 66 are of identical shape the distances around the roller and pulleys in planes perpendicular to the axis of the roller are substantially the same, whereby the belt 67 can be readily moved parallel to the axes of the pulleys without forming slack or becoming overtaut.

As indicated schematically in FIG. 11, a follower 68 carried by a scroll 69 effects motion of the belt 67 along the axes of the pulleys 65 and 66. In FIG. 11, the follower 68 and scroll 69 are for convenience of illustration shown below the drive roller 63, but are in fact and as shown in FIG. 12 located within the triangular configuration formed by the roller 63 and the cone pulleys 65 and 66.

As best seen in FIG. 12, the follower 68 carries three pairs of arms 70, 71, 72 for engaging the belt. The pairs of arms 70, 71, 72 are arranged as shown in FIG. 12 at predetermined angular spacings around the axis of the scroll 69 and each arm carries a roller 73, with the arms of each pair spaced such that the associated rollers engage opposite edges of the belt 67. The pair of arms 70 is arranged to engage the belt conveniently at an intermediate point between the pulleys and then extend beyond the belt as best seen in FIG. 13, with each arm terminating in a ring 74 engaging a rod 75 which prevents rotation of the follower 68 about the axis of the scroll 69. In this way, rotation of the scroll 69 will cause the belt 67 to traverse the length of the roller 63 and pulleys 65 and 66, the direction of motion being changed automatically at the ends by reversal of the direction of lead of the thread of the scroll. Limit switches 76 and 77 are for a purpose hereinafter to be described provided for indicating when the follower 68 reaches respective ends of the scroll 69.

Drive to the scroll 69 is taken from the drive shaft 61 by a belt 78 engaging a pulley 79 on the shaft 61. The belt drives a shaft 80 via a clutched pulley 81, the shaft 80 serving as the input to an infinitely variable 'H' gear box 82, which serves as a reduction gear box and variation of which is effected by a manually operable control knob 83. Output from the gear box 82 passes through a second infinitely variable 'H' gear box 84 and via a belt 85 and pulleys 86 and 87 to the scroll 69. The variation of the second 'H' gear box is effected by a cam 88. The cam 88 is driven by the scroll 69 via pulleys 89, 90 and belt 91 in such a way that it rotates once for each traverse of the follower 68 along the scroll 69. The cam 88 effects the variation of the gear box 84 via a drive bar 92 and a rack and pinion arrangement 93.

The variation provided by the gear box 84 and the cam 88 enables a more complex motion to be given to the follower 68 by the scroll 69 than the constant speed motion provided when the gear box 84 and cam 88 are omitted or rendered ineffective. In certain circumstances it has, however, been found that the gear box 84 and the cam 88 can be omitted and that the simple constant speed motion is acceptable.

The cone pulleys 65, 66 communicate drive to drive shafts 94, 95 via clutches 96, 97. The drive shaft 94 communicates drive via a pulley 98, a belt 99 and a drive wheel 100 to a drive tape 101 which is guided over four guide pulleys 102 to 105 and which drives the bobbin tube mounting and drive members 39 supporting bobbin tubes 42 at each winding position. Similarly, the shaft 95 communicates drive via a pulley 106, belt 107, drive wheel 108 to a drive tape 109, which is guided by guide pulleys 110 to 113 and which drives the bobbin drive tube mounting and members 41 supporting bobbin tubes 43 at each winding position.

The clutches 96, 97 enable the drive members 39, 41 to be stopped when it is desired to doff a package, in order that the package is stationary when doffed and to leave the bobbin which is not being filled stationary.

The package build traversing movement of the arms 45 to wind the roving in parallel wound arrangement is produced by a tape drive shown only schematically in FIG. 11. Each arm 45 is pivotally carried by its support arm 46 which is fixedly mounted on a tape 114 mounted on pulleys (not shown) for longitudinal reciprocating motion in the direction of the bobbin tube axis. The tape 114 is drivably engaged by a pulley 115 fixed on a shaft 116, which is caused to rotate alternately in opposite directions by controlled amounts and at controlled speeds.

The shaft 116 receives its controlled drive, via a reversing mechanism 117, explained hereinafter, from a shaft 118 which is in turn driven, via an adjustable gear 119, a shaft 120, a pulley and belt arrangement 121, from a shaft 122. The shaft 122 is driven either by the cone pulley 66 via a selectively operable clutch 123, or by the cone pulley 65, via a selectively operable clutch 124, belt and pulley arrangement 125 and the shaft 94, in dependence upon whether winding is taking place upon the bobbin tubes 43 or on the tubes 42. In this way, the shaft 116 is driven at a speed proportional to the rotational speed of the bobbin tube on which winding is taking place and hence proportional to the diameter of the package being formed. Therefore, as the diameter of the package grows, the speed of traversing decreases to accommodate the increase in the circumference of the package and to maintain constant the spacing between adjacent turns of the roving.

The reversing mechanism 117 comprises a first shaft 126 receiving drive from the shaft 118 and a second shaft 127, the shafts carrying meshing gear wheels 128, 129 whereby the shaft 127 is driven in opposite direction to the shaft 126. The shafts 126, 127 carry pulleys 130, 131, which can be keyed to the shaft for corotation on operation of clutches 132, 133. The pulleys 130, 131 communicate drive via a belt 134 to a pulley 135 on the shaft 116. In this way, depending upon which of the clutches 132 or 133 is operated, the shaft 116 will be driven in the same direction as the shaft 118 or in the opposite direction thereto. Switching of the clutches 132, 133 thus controls the package build traversing movement and is effected by two pairs of sensors 136, 137 which cooperate with a template 138 carried by one of the arms 45 in such a way that it carries out package build traversing motion therewith. For the convenience of illustration, the arrangement of the sensing devices 136 and 137 and the template 138 have been shown in FIG. 11 as appearing in the plane of the paper. They are of course in fact arranged in a horizontal plane with the template moving horizontally and not vertically as illustrated. The first pair of sensors 136 cooperate with one side of the shaped template 138 and the other pair 137 with the other side. An additional pair of sensors 139, 140 are positioned at the sides of the template 138, as shown, for a purpose that will be explained hereinafter. The sensors 136, 137, 139 and 140 are held stationary on the machine main frame so that the template moves relative to them.

The arms 45, the shaft 116, the reversing mechanism 117 and the template 138 are all carried upon a carriage 141 whereby they are moved together to accommodate increases in package diameter. For this reason, the shaft 118 is coupled at its ends by universal joints 142, 143 to allow the shaft 118 to take up this motion. Switches 144 and 145 are positioned at respective ends of the carriage 141 to indicate when the carriage reaches a position immediately before the full extent of its travel, as will be explained in more detail hereinafter.

As mentioned hereinbefore, the follower 68 is controlled by the scroll 69 to vary the speed of the drive members 39 and 41 and in dependence upon the diameter of the package at any instant to control winding, and hence its motion is dependent upon package diameter. Thus the amount of rotation of the scroll 69 is dependent upon package diameter.

In order to control the carriage 141 so as to move the arms 45 such that they remain vertical and tangential to the package at any instant, the motion of the scroll 69 is communicated via a drive shaft 146, belt and pulleys 147, reduction gear 148, drive shaft 149, pulleys 150, 151 and belt 152 to a second scroll 153 with a follower 154. The scrolls 69 and 153 are arranged such that during the time the follower 68 traverses from one end to the other, the follower 154 similarly traverses from one end to the other and accordingly its motion is also dependent upon the diameter of the package being wound.

The carriage 141 is moved by the follower 154 (via a transfer mechanism 155 explained hereinafter) and hence the arms 45 are moved in dependence upon the diameter of the package and are retained in the correct position for winding, that is, vertical and tangential to the package.

The transfer mechanism 155 comprises a pair of back-to-back pneumatic cylinders 156, 157 with pistons 158, 159. The piston 159 is attached to the follower 154 and the piston 158 to the carriage 141. Air supply to both sides of each piston is provided whereby the carriage can be moved an additional amount in either direction over and beyond the travel provided by the scroll 153 and follower 154 for the purposes of transferring winding from one bobbin to the other.

In operation of the device, in conditions (not as shown) where winding of roving has just commenced upon bobbins 43 supported by the drive member 41, the belt 67 is arranged (not as shown) at the left hand end of the roller 63, that is to say, the follower 68 is arranged at the left hand end of the scroll 69 having just reversed direction.

Similarly, the follower 154 is arranged at the left hand end of the scroll 153 such that the arms 45 are at the left hand end of their traverse, that is to say, adjacent the surface of the bobbin tubes on the drive members 41. Clutches 96 and 124 are declutched whereby the drive members 39 are stationary and the shaft 122 is driven by the cone pulley 66 via the engaged clutch 123. Sensors 137 are activated and sensors 136 deactivated such that pulses are emitted from the former only.

As the belt 67 engages the narrow end of the cone pulley 66, the pulley 66 and hence the bobbin drive members 41 are driven at their maximum speed, which is so correlated with the delivery speed of the roving that the surface speed of the bobbin is equal to the delivery speed of the roving, thereby providing the correct conditions for wind-up of the roving. Rotation of the drive shaft 61 to drive the pulley 66 and bobbin drive members 41 also causes rotation of the scroll 69 via the gear boxes 82 and 84 at a speed very much less than that of the pulley 66 whereby the follower 68 and hence the belt 67 are moved along the pulley 66 toward the right hand end. This causes the speed of the pulley 66 and the bobbin drive members 41 to decrease until at the position shown in FIG. 1 the belt 67 is at the right hand end of the pulley 66 and the drive member 41 are driven at their slowest speed.

Rotation of the drive shaft 122 causes the arms 45 to traverse the packages on the bobbin drive members 41 to build up the first layer of roving in parallel turns. At the same time, the template 138 is traversed between the pairs of sensors 136, 137. The shape of the template is so chosen that it defines the required tapered shape of the package and at the position of commencement of winding the activated sensors 137 cooperate with the narrowest part of the template 138. In this way, the template and hence the arms 45 move the maximum distance from one sensor 137 before the template triggers the other sensor 137, the triggering of each sensor reversing the condition of the two clutches 132 and 133 and thereby reversing the direction of traverse of the arms 45.

As the scroll 69 is rotated, the scroll 153 rotates similarly and moves the follower 154 from the left hand end towards the right in dependence upon package diameter, whereby the arms 45 remain vertical and tangential to the packages being formed on the bobbins carried by drive members 41. Additionally, the template 138 is moved traversely relative to the sensors 137 so as to present gradually widening surfaces to the sensors. In this way, the extent of the traverse between reversals is gradually reduced to produce an end-tapered parallel-build package.

Furthermore, as the scroll 69 is rotated the speed of the cone 66 decreases and therefore the speed of the shaft 116 decreases to reduce the traverse speed of the arms 45.

For winding of the roving to take place correctly, the surface speed of the packages at any diameter must be equal to the delivery speed of the roving and to provide this condition adjustment of the gear box 80 must be made in dependence upon the count and material of the roving supplied. Thus adjustment is made to ensure that the rate of rotation of the scroll 69 is such that the follower 68 reaches the right hand end at the time when the packages are full.

As the roving delivery speed is constant, the surface speed of the packages, within small limits, must remain similarly constant. The surface speed is dependent upon the diameter of the packages and the angular speed of the packages is dependent upon the position of the follower 68 on the scroll 69 and hence the follower 68 must be moved by the scroll such that it follows the increase in diameter of the packages. If the rate of increase in diameter is linear, the rate of motion of the follower 68 between the extreme left and right hand positions must also be linear whereupon no adjustment of the gear box 84 is necessary. If some departure from a linear condition is necessary then this is accommodated by a suitable choice of shape for the cam 88.

Thus, the adjustment for the gear box 82 and the shape of the cam 88 is set before commencement of winding to ensure correct winding of the roving on the packages, that is to say, to retain the tension substantially constant throughout the package build.

When the followers 68 and 154 have reached the right hand ends of the scrolls 69 and 153 (as shown in FIG. 11), the packages of roving on the bobbins supported by the drive members 41 are full and the machine is ready for transfer of the rovings to the bobbin supported by drive members 39. In this position the arms 45 are very closely adjacent the positions to be taken by empty bobbins on the drive members 39.

Immediately before the follower 68 reaches the end of the scroll 68 the carriage 141 operates the switch 145 of the pair of switches 144 and 145, which activates a mechanism (not shown) for supplying bobbins to the drive members 39. At the next reversal point of the traverse mechanism as sensed by the sensors 137 a pulse is supplied by the sensor 137 to the main motor 60 to slow the machine to the order to one quarter of normal machine speed, to facilitate the transfer procedure. Following the reversal point, the follower 68 reaches the end of the scroll 69, which is sensed by the switch 77 of the pair of switches 76 and 77, which acts to stop the rotation of the scroll 69 by declutching the clutched pulley 81. This prevents the follower 68 commencing its reverse journey before transfer has taken place.

At the next reversal point as sensed by the sensors 137, air is supplied to the right hand side of piston 159 in the cylinder 157 to move the carriage 141 further to the right by an amount equal to the piston stroke. This causes the arms 45 to rest against the empty bobbins on the drive members 39, leaning at an angle to the vertical as their traverse motion continues. The bobbin, as hereinbefore explained, is provided with groove 58 and teeth 59 to pick-up the roving and to commence winding on the empty bobbin, thus breaking the roving between the full package and the empty bobbin.

Immediately the traverse motion has passed the pick-up groove 58, which is sensed by the switch 140 of the pair 139, 140, cooperating with the template 138, the carriage 141 is returned by the supply of air to the left hand side of the piston 159.

At the return, the machine speed is returned to full operation and the building motion is changed to operate in respect of the bobbin drive members 39. This is achieved by restarting the scroll 69 to commence the return journey of the follower 68 and the follower 154, by declutching the clutch 123 and engaging clutches 96 and 124, whereby the shaft 122 and hence the traverse motion is driven via the clutch 124 by the cone 65, and by activating the pair of sensors 136 associated with the other side of the template 138 and deactivating the sensors 137. At this time also, the full packages on the drive members 41 are removed. The building of packages on bobbins on the drive members 39 then continues in a symmetrical manner until transfer back to winding on bobbins on the drive members 41, which takes place in a symmetrical manner to the transfer just described.

It is found desirable to make provision for very rapid traversal of the mechanisms hereinbefore described with reference to FIG. 11 when a bad package is formed and it becomes necessary to remove it and restart the winding on the next empty bobbin. This is achieved in the arrangement shown in FIG. 11 by an over-ride drive 160 which transmits drive from an output shaft 161 of the roller 63 via a pulley 162, a belt 163 and a clutched pulley 164 to meshing gears 165 and 166 the latter of which is driveably fixed on the shaft 146 of the scroll 69. Upon the appearance of a bed package the clutched pulley 81 is declutched and the clutched pulley 164 is engaged, whereby a high speed drive from the roller 63 is transmitted to the scrolls 69 and 153 to bring the followers 68 and 154 rapidly to their end positions on the scrolls, whereupon transfer of the winding of roving onto the empty bobbins takes place as hereinbefore described and the bad package or packages removed.

In an alternative arrangement (not shown) the scroll 69 is replaced by a screw with a reversal in the direction of motion of the follower 68 being obtained by reversing the direction of rotation of the screw.

In yet another alternative arrangement (not shown) the scroll 69 is rotated in discrete steps so as more closely to follow the build up of the packages. This may be achieved by a pneumatic cylinder/piston which turns a sprag clutch driving the scroll, and which is driven in dependence upon pulses received from the sensors 136, 137.

We claim:

1. Apparatus for winding an elongate fibrous material comprising: package tube mounting means to support first and second package tubes in winding positions in transversely spaced parallel relationship; a material delivery arm for delivering material first to one of the package tubes to form a first package and then to the other of the package tubes to form a second package; drive means for rotating the package tubes for winding on material; said delivery arm being arranged during the building of a package to contact the package at a winding-on point which lies in a plane containing the axes of rotation of the two package tubes and to deliver material at the winding-on point direct to said package under a winding tension localised in the region of the winding-on point by the delivery arm; first traversing means for causing relative traversing movement between each package tube and the delivery arm in the direction of the axis of rotation of the tube for building a parallel-build package on the tube means for supporting the delivery arm, and second traversing means operative during the building of each package to monitor the increasing diameter of the package and to cause in a direction perpendicular to the axis of rotation of the tubes a relative displacement between the supporting means and the package tube to accommodate the increasing diameter of the package being built on the tube and to maintain the winding-on point in said plane.

2. Apparatus for winding an elongate fibrous material comprising: package tube mounting means to support first and second package tubes in winding positions in transversely spaced parallel relationship; a material delivery arm for delivering material first to one of the package tubes to form a first package and then to the other of the package tubes to form a second package; drive means for rotating the package tubes for winding on material; said delivery arm being arranged during the building of a package to contact the package at a winding-on point which lies in a plane containing the axes of rotation of the two package tubes and to deliver material at the winding-on point direct to said package under a winding tension localised in the region of the winding-on point by the delivery arm; first traversing means for causing relative traversing movement between each package tube and the delivery arm in the direction of the axis of rotation of the tube for building a parallel-build package on the tube and second traversing means operative during the building of each package to cause in a direction perpendicular to the axis of rotation of the tubes a relative displacement between the delivery arm and the package tube to accommodate the increasing diameter of the package being built on the tube and to maintain the winding-on point in said plane, the second traversing means being responsive to completion of a package on one of the tubes to cause further relative displacement between the delivery arm and the package tubes to bring the delivery arm to bear against the other package tube to effect transfer to the said other package tube of the material delivered by the delivery arm.

3. Apparatus according to claim 2, wherein the delivery arm is pivotally suspended from arm support means and said relative displacement between the delivery arm and the two package tubes during the build of each package is such as to maintain the delivery arm in a substantially vertical disposition throughout the build of a package on each tube.

4. Apparatus according to claim 3, wherein the arm support means is arranged during said further relative displacement to move beyond the position in which the delivery arm is vertical and contacts the said other package tube, thereby to incline the arm and cause it to bear against the periphery of the tube.

5. Apparatus according to claim 4, wherein the dispositions of the package tube mounting means are such that the delivery arm at the completion of a package on one of the tubes almost contacts the surface of the other package tube.

6. Apparatus according to claim 2, wherein the delivery arm is of generally cylindrical form and the material is guided to said winding-on point in a plurality of turns round said cylindrical portion.

7. Apparatus according to claim 6, wherein the delivery arm is symmetrical with respect to a plane passing through the longitudinal axis of the arm and includes an end portion adapted to deliver the material from one side thereof on one side of said plane to wind material on to one of the package tubes and to deliver the said material from the other side thereof on the other side of said plane for winding material on to the other package tube.

8. A textile machine for converting sliver to roving comprising sliver supply means arranged to provide two slivers for forwarding, means for drafting the forwarded slivers, twisting means for subjecting at least one of the drafted slivers to twisting, converging means for converging the two slivers to form a two-fold roving, and a winding device for winding the roving, said winding device comprising package tube mounting means to support first and second package tubes in winding positions in transversely spaced parallel relationship, a delivery arm for delivering the roving first to one of the package tubes to form a first package and then to the other of the package tubes to form a second package, drive means for rotating the package tubes to wind on the roving, said delivery arm being arranged during the building of each package to contact the package at a winding-on point which lies in a plane containing the axes of rotation of the two package tubes and to deliver the roving at the winding-on point direct to said package under a winding tension localised in the region of the winding-on point by the delivery arm, first traversing means for causing relative traversing movement between each package tube and the delivery arm in the direction of the axis of rotation of the tube for building a parallel-build package on the tube, and second traversing means operative during the building of each package to cause in a direction perpendicular to the axis of rotation of the tubes a relative displacement between the delivery arm and the package tube to accommodate the increasing diameter of the package being built on the tube and to maintain the winding-on point in said plane.

9. A machine according to claim 8, wherein said twisting means applies to at least one of the drafted slivers a twist such that the twisted sliver has repeated along the length alternating zones of opposite twist.

10. A machine according to claim 9, wherein the twisted sliver in converging with the other sliver to form the said two-fold roving is arranged partly to untwist around the other sliver to form a stabilised self-twisted two-fold roving.

* * * * *